United States Patent [19]

Zitz et al.

[11] 4,379,594

[45] Apr. 12, 1983

[54] PROCESS FOR SINKING OF SHAFTS

[75] Inventors: Alfred Zitz; Otto Schetina; Herwig Wrulich; Arnulf Kissich, all of Zeltweg, Austria

[73] Assignee: Voest-Alpine Aktiengesellschaft, Vienna, Austria

[21] Appl. No.: 204,382

[22] Filed: Nov. 5, 1980

[30] Foreign Application Priority Data

Nov. 9, 1979 [AT] Austria ..... 7210/79

[51] Int. Cl.[3] ..... E21D 1/06; E21C 41/00

[52] U.S. Cl. ..... 299/10; 299/75

[58] Field of Search ..... 299/10, 18, 39, 75, 299/76, 41; 37/195, DIG. 6

[56] References Cited

U.S. PATENT DOCUMENTS

| | | | |
|---|---|---|---|
| 720,841 | 2/1903 | Pawel | 299/75 |
| 3,098,641 | 7/1963 | Baldwin | 299/18 X |
| 3,317,245 | 5/1967 | Arndt | 299/76 |
| 4,162,104 | 7/1979 | Kogler et al. | 299/89 X |

FOREIGN PATENT DOCUMENTS

| | | | |
|---|---|---|---|
| 2720380 | 11/1978 | Fed. Rep. of Germany | 299/75 |

*Primary Examiner*—Ernest R. Purser

*Attorney, Agent, or Firm*—Cushman, Darby & Cushman

[57] ABSTRACT

For sinking of shafts, a cutting machine (1) is provided having its cutting arm (3) pivotable around a vertical axis (4) and a horizontal axis (5). The cutting arm (3) carries cutting heads (14) which are rotatable around an axis (15) horizontally arranged and extending perpendicularly relative to the axis of the cutting arm. The shaft is now sunk around its circumference (9) in direction of its axis (10), for which purpose first the uppermost lead of a screw surface is prepared. On this uppermost lead of the screw surface the cutting machine is advanced until the cutting heads (14) contact the shaft wall (9). In the following, a floor cut (19) is made whereupon a further floor cut (20) is made at a lower level. Starting from a corresponding position of the cutting machine surfaces (23, 24) are cut free starting from the shaft wall (9). This manner of operation is continued thereby repeating the previous process steps until the whole screw surface is cut free, the cutting machine thereby being moved in backward direction. Any area (30) possibly remaining close to the axis of the shaft and being not within the operating range of the cutting arm can subsequently be broken away or be removed by cutting operating in another position of the cutting machine (FIG. 2).

12 Claims, 2 Drawing Figures

PROCESS FOR SINKING OF SHAFTS

Figure 1:
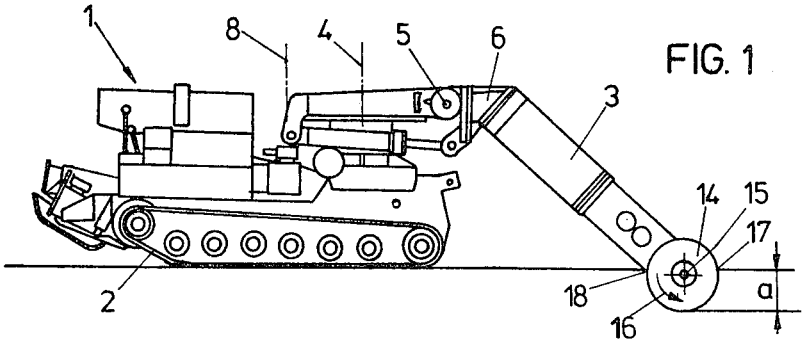

The present invention refers to a process for sinking of shafts. Sinking of shafts was up till now effected by drilling and blasting operation or mechanically with partial cut or full cut operation, the shaft sinking device being designed for movement in vertical direction by ropes and winch. The heap of debris was removed by means of a loading equipment taking the heap from the bottom of the shaft and transferring the heap of debris to a bucket-handling crane.

The known full cut devices are extremely heavy, bulky and expensive machines. For this reason, partial cut machines were used which have a lower weight and are characterized by lower costs of construction and do not require to erect aboveground expensive equipment for effecting vertical movements within the shaft. But also in this case, there must be at disposal an equipment just designed for this only single purpose, said equipment being, however, only with difficulties applicable in inclined shafts, so-called oblique shafts.

It is an object of the present invention to use usual cutting machines for the sinking of shafts and to simplify shaft sinking operation. The invention particularly refers to a process for the sinking of shafts by means of a partial-cut cutting tool and essentially consists in that the shaft is sunk by means of a partial-cut cutting machine having an universally pivotable cutting arm carrying at least one cutting head and having a chassis preferably being designed as caterpillar-type landing gear along a screw surface having its axis coinciding with the axis of the shaft to be sunk, the cutting machine being moved on said screw surface. In this manner, it becomes possible to use when sinking shafts cutting machines suitable for the exploration in galleries. In view of the cutting machine being moved on the screw surface having been cut by the cutting machine itself or having been prepared at the beginning of the sinking work in an other suitable manner such as for example by manual work or dredging, one can do without the mentioned expensive equipments for suspending the heavy sinking tool which has to be lowered into the shaft. When performing the process, the cutting machine is moving downwards lead after lead of the screw surface, thus increasing the depth of the shaft in direction of the preselected shaft axis. In view of the cutting machine moving on the screw surface it is even possible to sink oblique shafts because in this case only an inclined axis of the screw surface must be preselected. It is, for example, without further possible to sink shafts inclined for 75° or more relative to the horizontal. The surface on which the cutting machine can be moved is limited by the diameter of the shaft to be sunk. With this type of use of the cutting machine, the loading ramp and the conveyor means usually associated with the cutting machine are superfluous and, as a rule, also the rear floor support of the cutting machine will be superfluous. For increasing the stability of the cutting machine on operation, balast can, according to the invention, be applied to the front portion of the cutting machine. When working according to the process according to the invention, the cutting machine used is thus preferably a usual cutting machine having most of the constructional parts, such as loading ramp, conveyor means and rear floor support, protruding beyond the chassis dismantled.

According to the invention, the pitch of the screw surface is equal to the depth of the floor cut obtained with unchanged position of the cutting machine. Several floor cuts can be made without changing the position of the cutting machine, thereby increasing the cutting depth by each following floor cut.

According to a preferred embodiment of the invention, only one floor cut is made without changing the position of the cutting machine, the depth of said floor cut being limited by the possible cutting depth of the cutting head, which cutting depth corresponds, for example, to $\frac{3}{4}$ of the diameter of the cutting head. With a usual cutting machine the pivoted area of the cutting arm for downward movement is limited and the cutting arm is in its totally downwardly pivoted position downwardly declined to such a degree that it contacts non-cut rock already after the first floor cut. This condition is taken into account by the feature to effect only one floor cut. In addition, the pitch of the screw surface is reduced in this manner without, however, increasing the required amount of work. According to the invention, the floor cuts are conveniently set one immediately following the other.

According to a preferred embodiment of the process according to the invention, the screw surface is cut in sections extending in direction of the pivotal arc of the cutting arm from the shaft wall at least until close to the shaft axis and having, as seen in direction of the radius of the pivotal movement of the cutting arm, a width corresponding to several floor cuts. When cutting one section, the cutting machine can simply be backwardly moved in its track for one floor cut after the other. In this case the process is preferably performed such that at the beginning of the cutting work for one section, the cutting machine is brought into a position in which the cutting head is contacting the shaft wall when the cutting arm assumes the mid-position and in which the axis of the cutting machine includes an acute angle with the tangent at the contacting point with the shaft wall and in that after having terminated the floor cut in this position of the cutting machine, the cutting machine is backwardly moved in direction of its axis for one width of the floor cut until the cutting arm is only contacting the shaft wall in its maximum laterally pivoted position, starting from which position the last floor cut of the section is made. During this cutting operation it is only necessary to backwardly move the cutting machine along its track for approximately the width of a floor cut and in this manner the pivotal range of the cutting arm is best made use of. If in this case, the cut portion of the section is not extending to the shaft axis or to close to the shaft axis, the cutting machine is turned around its vertical axis in the position finally assumed by the cutting machine (which position is the most retracted one), whereupon the cutting machine is again moved in forward direction and the remainder of the section is cut by making floor cuts extending in essentially the same direction as are extending the floor cuts within the already cut portion of the section. In view of the cutting machine being backwardly moved, the cutting machine can be brought out of the last assumed position into a new position by simply rotating the cutting machine around its vertical axis. In this manner, arcuate sections are cut which are extending from the shaft wall till the shaft axis or till close to the shaft axis. Subsequently, the cutting machine is brought into a new position which corresponds to the starting position for cutting the first section and the next section is cut adjacent the previous cut section, noting that these sections may overlap. In this manner, the screw surface is cut from lead to lead of the screw surface until the shaft has the desired depth. In view of the cut screw surface forming the roadway for the cutting machine, existing ribs between the floor cuts can be filled with cut fines.

When using cutting machines in which the cutting head or the cutting heads are rotating around a horizontal axis extending perpendicularly relative to the axis of the cutting arm, the cutting heads are, according to the invention, preferably driven such that the bits are moving in upward direction at the side located far from the cutting machine and are moving in downward direction at the side facing the cutting machine. This provides the advantage, that the heap of debris obtained on cutting operation is moved away from the cutting machine and does not form a hindrance when making the subsequent floor cut.

When sinking the shaft in a formation which is not self-supporting, the walls of the shaft are in a usual manner reinforced or cladded by tubbings. Of course, vertical ribs remain on the shaft wall. The diameter of the cut shaft is therefore to be selected such that the tubbings may easily be inserted in spite of the remaining ribs.

For performing the process according to the invention a usual cutting machine can be used. According to a preferred embodiment of the invention, however, an angle piece is interpositioned between the vertical traversing gear of the cutting machine and the cutting arm by means of which the cutting arm is downwardly kinked relative to the vertical traversing gear. This provides the advantage that the cutting arm has a steeper inclination so that the cutting head can penetrate the shaft floor for a greater depth without part of the cutting arm colliding with the shaft floor. Furthermore, the area of action of the cutting arm is shifted by this measure closer to the cutting machine so that the stability of the cutting machine is increased. As a whole the possible undercut becomes as great as possible. Preferably, the gear for the cutting heads housed within the cutting arm is provided with a circulation-system lubrication. This provides the advantage that even with the cutting arm having such a steep inclination all parts of the gear are lubricated. If a splash lubrication would be used, the lubricating oil would, in view of the strong inclination of the cuttng arm, be accummulated at the forward area of the cutting arm so that lubrication within the rearward end of the cutting arm could become insufficient.

The invention is further illustrated with reference to the drawing illustrating an embodiment of the invention.

Figure 2:
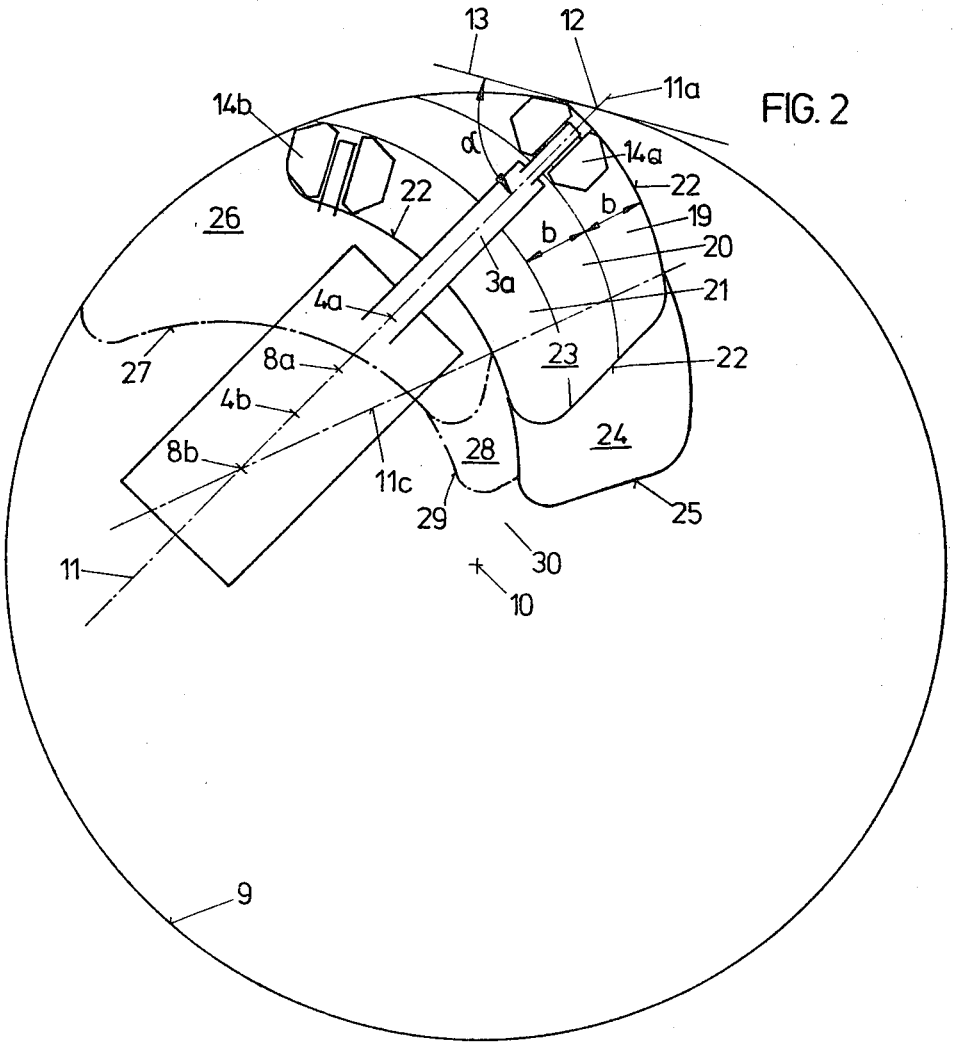

In the drawing:

FIG. 1 shows a cutting machine as used for performing the process according to the invention and FIG. 2 illustrates the process according to the invention for sinking shafts.

The cutting machine 1 has as usual a chassis fitted with crawler tracks 2. The cutting arm 3 is pivotable around a vertical axis 4 and around a horizontal axis 5 and thus universally pivotable. The cutting arm 3 carries cutting heads 14 rotating in direction of the arrow 16 around an axis 15 extending in horizontal direction and perpendicularly relative to the axis of the cutting arm 3. The sense of rotation of the cutting heads is selected such that the bits are upwardly moving at the side 17 remote from the cutting machine 1 and downwardly moving at the side 18 facing the cutting machine. 8 is the middle axis of the cutting machine 1. Between the vertical traversing gear being pivotable around the axis 5 and the cutting arm 3 there is provided an angle piece 6 so that the cutting arm 3 assumes a downwardly kinked position.

Performance of the process according to the invention is now illustrated in FIG. 2. 9 indicates the circumference of the shaft to be sunk or the wall of the shaft. 10 designates the axis of the shaft to be sunk. At the beginning of the process the uppermost lead of a screw surface is prepared. In view of the ground surface in most cases being formed of a soft material such as humus, the uppermost lead of the screw surface can be prepared by hand or by means of dredges or excavating machines. It is only when one encounters rock that the cutting machine must be used. The cutting machine 1 is placed at a position 1*a*, in which the mid-point of the cutting machine is designated 8*a* and the pivotal point of the cutting arm is designated 4*a*. The cutting arm 3 is brought into the position 3*a* in which it is directed in direction of the longitudinal axis 11 of the cutting machine said axis being in the position 11*a*. The position 11*a* of the longitudinal axis 11 must be adjusted such that the axis of the cutting arm assuming the position 11*a*, includes an acute angle $\alpha$ with the tangent 13 contacting the shaft wall 9 at the point 12 of intersection. The cutting machine is advanced until the cutting heads 14 contact the shaft wall 9 in the position 14*a*. Starting from this position the first floor cut 19 is made. Subsequently, the cutting machine is backwardly moved in direction of its axis 11, i.e. in its track, for a distance corresponding to the width b of a floor cut, whereupon the following floor cut 20 is made. Subsequently the cutting machine is again backwardly moved for a distance corresponding to the width b of the floor cut and in this position of the cutting machine the floor cut 21 is made. In this position the axis 8 of the cutting machine is in the position 8*b* and the pivotal axis of the cutting arm is in the position 4*b*. In this position the cutting heads 14 assume the position 14*b*, in which they contact the shaft wall 9 when approximately making use of of approximately the maximum cutting area. During this operation, a surface 23 is cut out of the shaft floor, said surface 23 being outlined by the line 22. This surface 23 does not yet extend close to the axis 10 of the shaft. Therefore, the cutting machine is swivelled around its vertical axis 8*b* to bring the cutting machine out of the position, in which the center of the machine is in the position 8*b* and the pivotal axis of the cutting arm is in the position 4*b* and the longitudinal axis is in the position 11*a*, into the position 11*c* of the longitudinal axis and then advanced for such a distance that the cutting heads 14 adjoin the floor cut 19 when the cutting arm is straightly directed in forward direction. Subsequently, a surface 24 is cut from the shaft floor in an analogous manner, said surface 24 being outlined by the line 25. A section 23, 24 has now been finished.

Subsequently, the cutting machine is again brought into a new position in which the cutting heads are contacting the shaft wall when the cutting arm is directed in straight forward direction. Starting from this position, a partial section 26 outlined by the dash-dotted line 27 is cut in an analogous manner, whereupon an adjoining partial cut 28 is made which is outlined by the dash-dotted line 29. In this manner the next section 26, 28 is cut which is overlapping the previously cut section 23, 24.

In this manner the whole screw surface is cut thereby backwardly moving the cutting machine again and again. The screw surface thus produced has a pitch corresponding to the depth a of a sole cut and the cutting machine is continuously backwardly travelling on this screw surface. During the described cutting operation there remains near the axis of the shaft an area 30 which is not within the range of the operating cutting heads. This area can either be fractured by the cutting arm or be cut by the cutting machine in its other position.

What is claimed is:

1. Process for sinking of shafts into the earth by means of a partial-cut cutting tool, characterized in that the shaft is sunk by means of a partial-cut cutting machine, having an universally pivotable cutting arm carrying at least one cutting head and having a chassis fitted with crawler tracks, along a screw surface in the earth having its axis coinciding with the shaft to be sunk, the cutting machine being moved on said screw surface.

2. Process as claimed in claim 1, characterized in that the pitch of the screw surface is equal to the depth of the floor cuts obtained when the position of the cutting machine is not changed.

3. Process as claimed in claim 1 or 2, characterized in that the floor cuts are made one immediately adjacent the other.

4. Process as claimed in claim 1, characterized in that only one floor cut is made without changing the position of the cutting machine, the depth of said floor cut being limited by the possible cutting depth of the cutting head, which cutting depths correspond, for example, to ¾ of the diameter of the cutting head.

5. Process as claimed in claim 1 characterized in that the screw surface is cut in sections extending in direction of the pivotal arc of the cutting arm from the shaft wall at least until close to the shaft axis and having as seen in direction of the radius of the pivotal movement of the cutting arm, a width corresponding to several floor cuts.

6. Process as claimed in claim 1 characterized in that at the beginning of the cutting work for one section, the cutting machine is brought into a position in which the cutting head is contacting the shaft wall when the cutting arm assumes the mid-position and in which the axis of the cutting machine includes an acute angle with the tangent at the contacting point with the shaft wall and in that after having terminated the floor cut in this position of the cutting machine, the cutting machine is backwardly moved in direction of its axis for one width of one floor cut each until, by making floor cuts in each intermediate position, the cutting arm is contacting the shaft wall in its maximum laterally pivoted position, starting from which position the last floor cut of the section is made.

7. Process as claimed in claim 1 characterized in that in the case that the cut portion of the section is not extending till the shaft axis or close to the shaft axis, the cutting machine is turned around its vertical axis, whereupon the cutting machine is again moved in forward direction and the remainder of the section is cut in analogous manner by making floor cuts extending in essentially the same direction as are extending the floor cuts within the already cut portion of the section.

8. Process as claimed in claim 1 characterized in that ribs existing between adjacent floor cuts are filled and flattened with small debris obtained on cutting operation.

9. Process as claimed in claim 1 characterized in that when using cutting machines in which the cutting head or cutting heads is or are rotating around a horizontal axis extending perpendicularly relative to the axis of the cutting arm, the cutting heads are driven such that the bits are moving in upward direction at the side located far from the cutting machine and are moving in downward direction at the side facing the cutting machine.

10. Process as claimed in claim 1 characterized in that a cutting machine is used having dismantled at least most of the constructional parts, such as loading ramp, conveyor means and rear floor support, protruding over the chassis.

11. Process as claimed in claim 1 characterized in that the front portion of the cutting machine is loaded by ballast.

12. A process for sinking a shaft having a generally circular wall into the earth by means of a self-propelled partial-cutting machine which has a universally pivotable cutting arm carrying at its outer end at least one cutting head which is rotatable about a horizontal axis, said process comprising locating the machine within the circumference of the shaft to be sunk in a position such that the cutting head is engageable with said circumference and such that the longitudinal axis of the machine makes an acute angle with the tangent at the contact point between the cutting head and said circumference, swinging the cutting arm in an arc about a vertical axis to thereby cut an arcuate section which extends from said circumference to a point close to the axis of the shaft to be sunk, self-propelling the machine downwardly along a helical path concentric to the axis of the shaft and continuing to cut additional arcuate sections by swinging movement of the cutting head thus increasing the depth of the shaft.

* * * * *